US010596439B2

(12) United States Patent
Livingston, Jr.

(10) Patent No.: US 10,596,439 B2
(45) Date of Patent: Mar. 24, 2020

(54) SWIM SPA HAVING A WALL INSERT

(71) Applicant: David R. Livingston, Jr., Williamsport, PA (US)

(72) Inventor: David R. Livingston, Jr., Williamsport, PA (US)

( * ) Notice: Subject to any disclaimer, the term of this patent is extended or adjusted under 35 U.S.C. 154(b) by 0 days.

(21) Appl. No.: 16/192,295

(22) Filed: Dec. 13, 2018

(65) Prior Publication Data

US 2019/0134479 A1 May 9, 2019

Related U.S. Application Data

(63) Continuation-in-part of application No. 14/997,687, filed on Jan. 18, 2016, now abandoned.

(51) Int. Cl.

| | |
|---|---|
| ***A63B 69/12*** | (2006.01) |
| ***F15D 1/10*** | (2006.01) |
| ***A61H 33/00*** | (2006.01) |

(52) U.S. Cl.

CPC ..... *A63B 69/125* (2013.01); *F15D 1/10* (2013.01); *A61H 33/0087* (2013.01); *A63B 2210/50* (2013.01); *A63B 2225/09* (2013.01)

(58) Field of Classification Search

CPC ..... E04H 4/00; E04H 4/1245
USPC ..... 4/492, 904
See application file for complete search history.

(56) References Cited

U.S. PATENT DOCUMENTS

| | | | |
|---|---|---|---|
| 4,290,153 | A | 9/1981 | Kockerols et al. |
| 4,352,215 | A | 10/1982 | Laing |
| 4,907,304 | A | 3/1990 | Davidson et al. |
| 5,044,021 | A | 9/1991 | Murdock |
| 5,207,729 | A | 5/1993 | Hatanaka |
| 9,038,208 | B2 | 5/2015 | Ferriss et al. |

FOREIGN PATENT DOCUMENTS

| | | | |
|---|---|---|---|
| GB | 2296861 | A | 7/1996 |

*Primary Examiner* — Christine J Skubinna
(74) *Attorney, Agent, or Firm* — Zale Patent Law, Inc.; James R. McDaniel; Lawrence P. Zale

(57) ABSTRACT

An improved swim spa is described which has a tank having a head end and a foot end filled with water. A forward current is created by pumping equipment which directs the forward current from a head end of the tank, past a swimmer in the water to a foot end of the tank. The pumping equipment may be attached to a removable wall insert to which may be removed to allow easy repair and maintenance. The forward current allows the swimmer to swim in place. The width of the forward current is chosen to be at least twice its depth. A diverter at the foot end of the tank has a curved surface for redirecting the forward current toward the sidewalls and then back toward the head wall in a horizontal plane and downward and back toward the head wall in a vertical plane.

13 Claims, 9 Drawing Sheets

SWIM SPA HAVING A WALL INSERT

CROSS-REFERENCE TO RELATED APPLICATIONS

This application is a continuation-in-part of U.S. patent application Ser. No. 14/997,687, filed on Jan. 18, 2016, the disclosure of which is hereby incorporated by reference in its entirety to provide continuity of disclosure to the extent that such a disclosure is not inconsistent with the disclosure herein.

STATEMENT REGARDING FEDERALLY SPONSORED RESEARCH

Not Applicable.

BACKGROUND

1. Field of Invention

The present invention relates to a swim spa that provides water current toward a swimmer to allow in-place swimming, and more particularly an improved swim spa that more efficiently provides water current toward a swimmer to allow in-place swimming and which includes a wall insert to allow the pumping equipment to be easily accessed for maintenance, repair and/or replacement.

2. Description of Related Art

Swim Spas

Prior art swim spas have provided circulating water current in swim spas for the purpose of allowing swimming in a small confined swimming pool, or a swim spa. United Kingdom Patent GB 2 296 861 A entitled "Swimming Pool Having Circulating Water Flow" published Jul. 17, 1996 by Spaform Limited describes such a swim spa. This has a water propulsion device, such as a water pump, that forces a jet of water through an opening in an intermediate wall near a head wall into the spa toward a foot wall, past a swimmer, thereby allowing the swimmer to swim in-place and exercise. Once the water stream is past the swimmer, it impacts the back wall of the spa. In this patent, two orderly streams are shown that angle to the left and to the right, then curve toward the front.

In reality, the oncoming stream expands by friction with water below it to become a deeper stream as it progresses from the front wall to the back wall. This water stream impacts the back wall and rebounds toward the front wall, but encounters the oncoming stream. The collision of the oncoming stream and the rebounding water causes turbulence which is worst near the foot wall of the swim spa. Since there is a constant stream passing down the middle of the swim spa, the turbulent rebounding water finds its way to either side of the stream and back toward the front wall. This causes considerable turbulence and interference with the water stream, slowing it and creating turbulence which increases toward the sides of the stream. The turbulence and interference with the water stream cause the stream's velocity and force to be diminished. Therefore, stronger pumps requiring more energy must be used to attain a desirable stream intensity suitable for the swimmer to swim in place. All factors being equal, a pump which is required to provide additional water speed, will not last as long as one that is required to provide lower water speed. Therefore, pump life is reduced by an inefficient system.

Published US Patent Application 2008/0148470 A1, now U.S. Pat. No. 9,038,208, May 26, 2015 by Ferris et al., entitled "Swim Spa With Plenum Arrangement at Head End" describes a similar design as that of the Spaform Limited patent described above. However, Ferriss has sidewalls which bulge inward at various points. These bulges actually slow or partially inhibit the water from returning along the sidewalls toward the head end. The inward side bulges are counterproductive, decrease the efficiency of the swim spa and increase the amount of energy required to operate the swim spa.

There have been attempts to reduce the turbulence and increase the efficiency of the swim spa described in U.S. Pat. No. 5,044,021, Sep. 3, 1991 by Murdock entitled "Continuous Swimming Apparatus" which employs side conduits which run the length of the swim spa. They have an opening at the foot end which allows the water to enter the conduits then pass through the conduits to the front end where they enter the intake to the pump. This segregation between the water traveling down toward the foot end and the return water passing in the opposite direction reduces turbulence and wasted energy. The problem with this design is that it considerably increases the weight and cost of the swim spa.

Similarly, U.S. Pat. No. 5,207,729, May 4, 1993 by Hatanaka entitled "Circulating Type Water Flow Pool" discloses a swim spa having a partial second floor which creates a conduit also passing from the foot end of the swim spa to the head end. Although this design also reduces the turbulence and energy required to operate the device, it increases the weight and cost of the swim spa.

As the swimmer is swimming in the forward current, the swimmer sometimes swims a little to the left or right of center. Since the forward current in swim spas on the market typically use a single propeller to create the forward current, the forward current is only the width of a single propeller. If the swimmer deviates slightly to the left or right of the center of the forward current, the swimmer is no longer in the forward current and must reposition him/herself.

Also, since the prior art swim spas use a single propeller, they create a forward current which is as deep as it is wide. This deep forward current significantly interacts with the return current and reduces the efficiency of the system.

Finally, current, prior art swim spas do not have an efficient way to access the pumping equipment if the pumping equipment needs to be maintained, repaired or replaced. Currently, at least a portion of the water from the swim spa must be removed from the swim spa in order to access the pumping equipment in order to maintain, repair or replace the pumping equipment.

Currently, there is a need to provide an improved swim spa which has a wider forward current, is more efficient without reducing operation costs, and increases pump life and which is able to access the pumping equipment without removing any of the water from the swim spa so that the pumping equipment can be maintained, repaired or replaced.

BRIEF DESCRIPTION OF THE DRAWINGS

The advantages of the system described in this application will become more apparent when read with the exemplary embodiment described specification and shown in the drawings. Further, in the accompanying drawings and description that follow, like parts are indicated throughout the drawings and description with the same reference numerals, respectively. The figures may not be drawn to scale and the proportions of certain parts have been exaggerated for convenience of illustration.

SUMMARY

Figure 1:
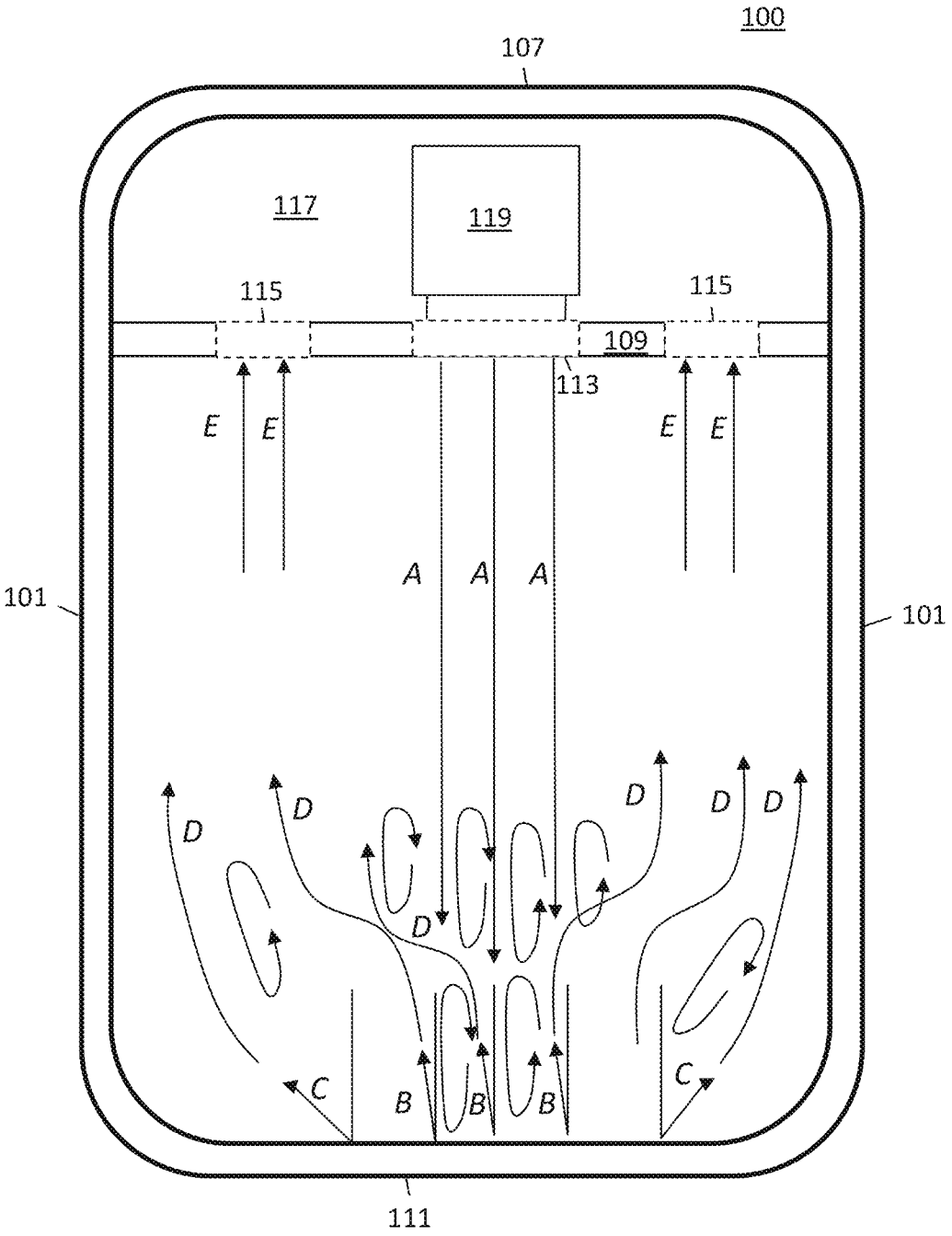
FIG. 1 is a plan view of a prior art swim spa illustrating water flow.

The current invention may be embodied as an improved swim spa having a tank with a head end and a foot end, the tank being filled with a volume of water, the tank having two side walls each having a head end and a foot end, a foot wall positioned substantially perpendicular to the side walls, connecting the foot ends of the side walls, a head wall positioned substantially perpendicular to the side walls, connecting the head ends of the side walls enclosing the tank.

The tank includes pumping equipment that has at least two side-by-side propellers that force a forward current of water through one or more conduits at a surface of the water, wherein the forward current has a width at least twice its depth. A diverter is positioned at the foot wall having at least one curved surface for smoothly diverting the forward current toward at least one side wall, reducing turbulence and the energy required to operate the swim spa. In an alternative embodiment, the curved surface of the diverter has a parabolic shape.

The invention may also be embodied as a method of allowing a swimmer to swim in place by providing a tank filled with water by providing a forward current from a head end of the tank toward a swimmer. The forward current has a width which is at least twice its depth.

The forward current is redirected back toward the head end of the tank with a diverter having a smooth curved surface to result in a more efficient swim spa. In an alternative embodiment, the curved surface of the diverter approximates a parabolic shape.

Finally, the invention may be embodied as a swim spa wall insert that can be removably secured within the swim spa such that the pumping equipment is attached to the swim spa wall insert, wherein the swim spa wall insert is still be able to be lifted away from the swim spa insert retainers for maintenance, repair or replacement of the pumping equipment.

DETAILED DESCRIPTION

The present invention will now be described in detail by describing various illustrative, non-limiting embodiments thereof with reference to the accompanying drawings. The invention may, however, be embodied in many different forms and should not be construed as being limited to the illustrative embodiments set forth herein. Rather, the embodiments are provided so that this disclosure will be thorough and will fully convey the concept of the invention to those skilled in the art. The claims should be consulted to ascertain the true scope of the invention.

1. THEORY

The goal of a swim spa is to provide an oncoming current of water directed from the head end of the swim spa into a swimmer and toward the foot end of the swim spa (forward current). The swimmer is typically swimming on the surface of the water in a direction toward the head end and into the oncoming water current.

If the swimmer swims at the same speed as the current, the swimmer remains in the same location relative to the swim spa. This allows a swimmer to swim in place and exercise without the need of a large, expensive swimming pool.

There are water pumps which create the water current, and require energy to operate. The amount of energy required to create a desired current flow decreases when there is an organized current flow circuit and the backpressure is low. Backpressure is typically caused by turbulence or collision with currents in the opposite direction, as described above. This increased backpressure not only requires more energy, but also reduces the lifespan of the pumping equipment. Therefore, if one can reduce this backpressure and develop organized current circuits, the swim spa will become more efficient and have a longer life.

As described above, the dedicated return conduits, on the sides or under the floor, work well to create more organized current flow; however, it makes the swim spas more costly. Little work has been done on trying to optimize the current flow of swim spas which do not employ dedicated current return conduits.

A water current passing through slower water, causes a frictional force on adjacent water molecules (water layer) causing them to move in the same direction as the water current, effectively 'hitching a ride'. This friction diminished with each successive water layer as the distance from the center of the water jet increases. As the water jet moves down the swim spa, the amount of water travelling with the water jet increases leading to a current at the foot end which is significantly deeper than at the head end.

The goal is to apply a forward current from the head end to foot end current passing around the swimmer that has a cross-sectional width and height approximately the same as that of the swimmer when in a prone position swimming on top of the water. This minimizes the forward current to areas to the left, right and below the swimmer. This allows these areas to the left, right and below the swimmer to be used as return paths from the foot end of the swim spa to the head end (reverse flow).

2. FLOW ANALYSIS

FIG. 1 is a plan view of a prior art swim spa illustrating water flow. The prior art swim spa has a head wall 107, two side walls 101, and a foot wall 111. It also includes an intermediate wall 109 that creates a plenum 117 between the intermediate wall 109 and head wall 107. The pump and other mechanical apparatus are in the plenum 117. The pumping equipment function to pump water from inside of the plenum 117 out through an output window 113 as the forward current indicated by arrow marked "A". This arrangement is similar to that shown in several prior art devices.

The output of the pumping equipment is a forward current marked by the arrows "A" which pass through output window 113. Forward current "A" encounters the swimmer as the swimmer is swimming on the surface of the water, passes from the swimmer's head toward his/her feet around the swimmer, then toward the foot wall 111. These currents impact the foot wall 111 and rebound as shown by arrows "B" back toward the intermediate wall 109. As they do, they encounter the stronger forward current indicated by arrows "A". The forward current, Arrows "A", may also divert the rebounding water outward near the foot wall, as indicated by arrows "C".

The currents of arrows "B" and "C" are diverted outward as indicated by arrows "D" as they encounter the forward current, arrow "A". The water currents then find their way to inlets 115 as shown by arrows "E".

The collision of the rebounding water, Arrows "B" and forward current, Arrows "A" cause considerable turbulence and loss of energy, making the design somewhat inefficient.

The water currents of FIG. 1 were only described for a two-dimensional space. In reality, the currents are three-dimensional.

Figure 2:
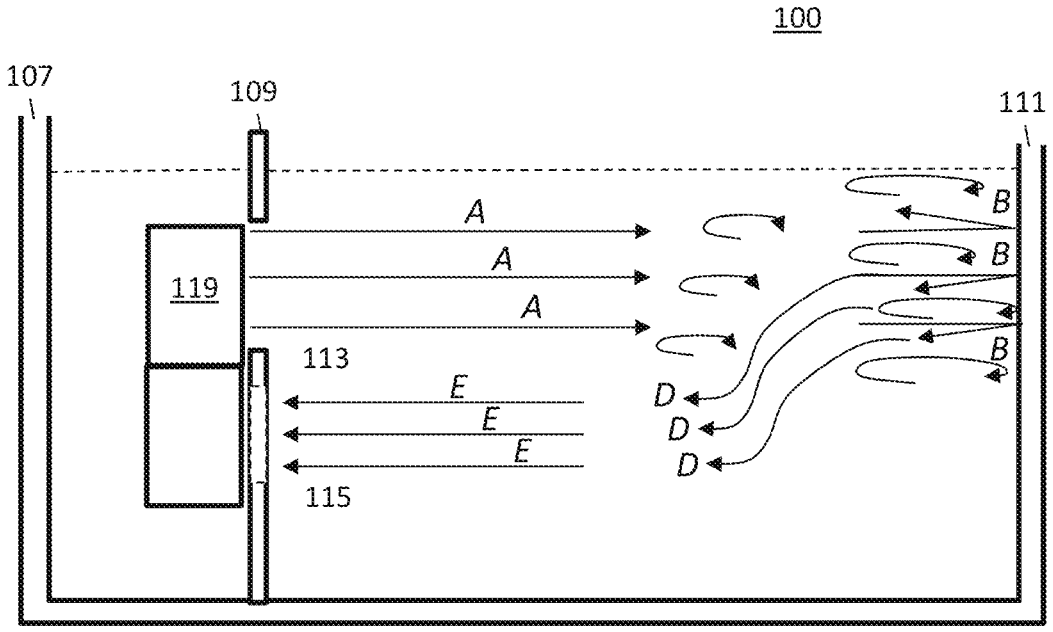
FIG. 2 is a side elevational view of the prior art swim spa of FIG. 1 illustrating water flow.

FIG. 2 is a side elevational view of the prior art swim spa 100 of FIG. 1 illustrating water flow. The output of the pumping equipment 119 produces the forward current indicated by arrows "A" which pass through output window 113 and down the center of the swim spa. The water currents of arrow "A" impact the foot wall 111 and rebound as shown by arrows "B", back toward the intermediate wall 109. As they do, they encounter the stronger forward current indicated by arrows "A". The current is diverted downward as indicated by arrows "D". Then the water currents find their way to inlets 115 as shown by arrows "E".

The collision of the rebounding water indicated by Arrows "B" and "C", with the forward current, indicated by arrows "A", cause considerable turbulence and loss of energy in this dimension.

If one were to tailor the size and shape of the forward current to match the size and shape of a swimmer as (s)he is swimming, and minimize the interaction between the forward current, arrows "A", and the rebound stream, arrows "B", a more efficient design may be achieved.

Figure 3:
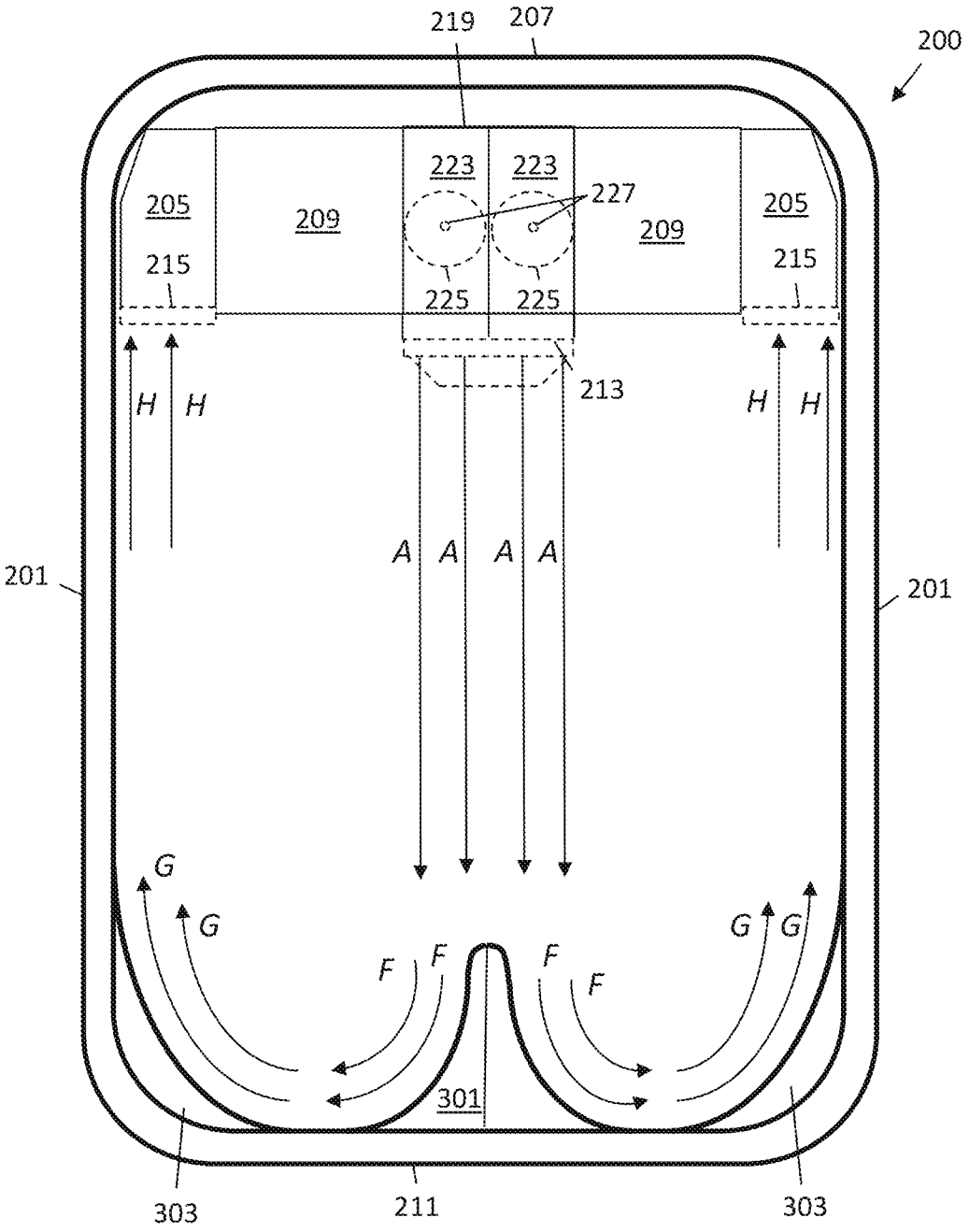
FIG. 3 is a plan view of an embodiment of a swim spa according to the invention, illustrating water flow.

FIG. 3 is a plan view of an embodiment of a swim spa 200 according to this invention, illustrating water flow. The swim spa 200 includes a head wall 207, two side walls 201 and a foot wall 211. It also includes an inlet tank 209 near the head wall 207. Pumping equipment 219, shown in this embodiment includes two side-by-side propellers 225 which rotate on substantially vertical shafts 227. These propellers 225 are driven to pump water from inlet tank 209 out through an output window 213 as the forward current illustrated by arrows "A". Preferably, this output window 213 has a size and shape which would create a forward current which would be approximately the height and width of the swimmer in his/her swimming position at the point it reaches the swimmer.

Figure 4A:
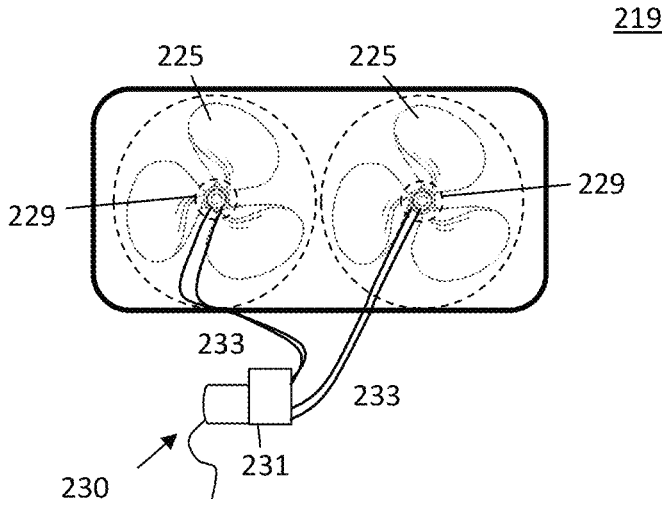
FIG. 4A is an illustration of an embodiment of a swim spa with two side-by-side propellers driven by a hydraulic pump according the invention.

In an embodiment of the invention shown in FIG. 4A, the pumping equipment 219 employs a single drive mechanism 230 which drives a plurality of side-by-side propellers 225. In this embodiment, the drive mechanism 230 are hydraulic motors 229 driven by a hydraulic pump 231. The hydraulic motors 229 may be fluid turbines which receive high pressure hydraulic fluid causing them to rotate a shaft connected to the propeller 225. The hydraulic pump 231 may an electric motor providing high pressure hydraulic fluid through a hydraulic line 233. The hydraulic pressure which may reach 1200 psi. After passing through the hydraulic motor 229, the fluid returns to the hydraulic pump 231 through a return hydraulic line 233.

In the preferred embodiment, there is a single hydraulic pump that feeds high pressure hydraulic fluid to the hydraulic motors. This causes all motors to run equally and provides a homogeneous forward current which has very similar speed and volume on either side of the forward current.

Figure 4B:
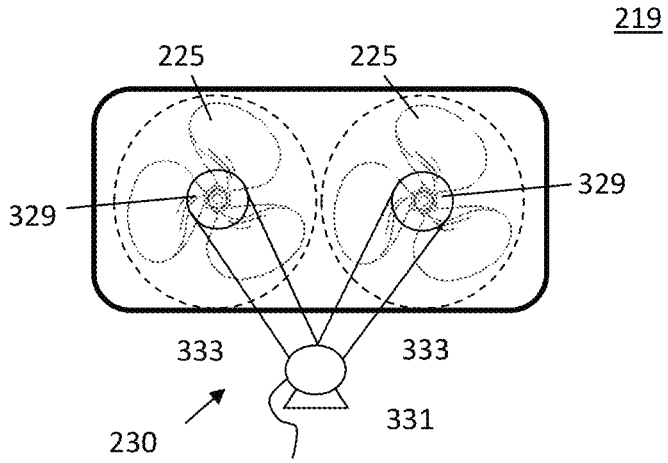
FIG. 4B is an illustration of an embodiment of a swim spa with two side-by-side propellers driven by an electric motor and pulley system according the invention.

In FIG. 4B another embodiment is shown of the drive mechanism 230. In this embodiment, an electric motor 331 drives belts 333 which drive pulleys 329. As with the embodiment of FIG. 4A, a single drive mechanism 230 drives more than one side-by-side propeller 225. This geometry creates a forward current which is at least twice as wide as it is deep.

Even though the example embodiment shows two propellers, it is possible and within the spirit of the invention to have multiple side-by-side propellers.

The purpose of using two or more side-by-side propellers creates a forward current which is wider than it is high. The dimensions may be selected to create a wider forward current which is wider and not as deep as prior art designs.

In prior art designs, an electric motor is used to power the propeller. Since this is a wet environment, it causes corrosion of the motors if there is a leak in the seal. In other prior art designs, the motors were placed outside of the tank and a shaft was inserted through the tank head wall. This also causes problems of leakage around the shaft.

Figure 6:
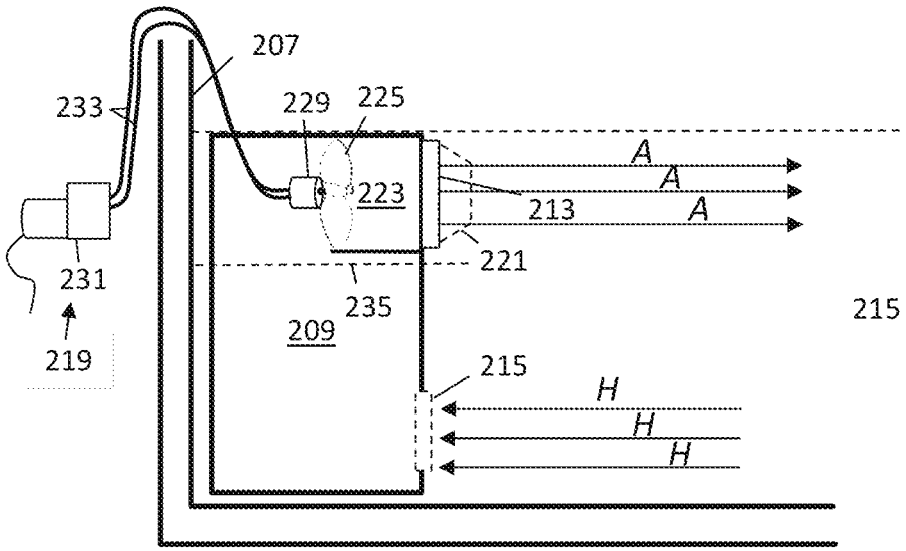
FIG. 6 is a partial side elevational view of another embodiment of a swim spa according to the invention, illustrating water flow.

Hydraulic motors 229 may be made of materials which do not corrode when positioned in the water. Also, the use of hydraulic motors 229 allows the use of flexible hydraulic lines 233 which can be routed over the head wall 207 as shown in FIG. 6. This design does not require a breach in the head wall 207 and eliminates leaks caused by breaching the head wall 207.

Figure 5:
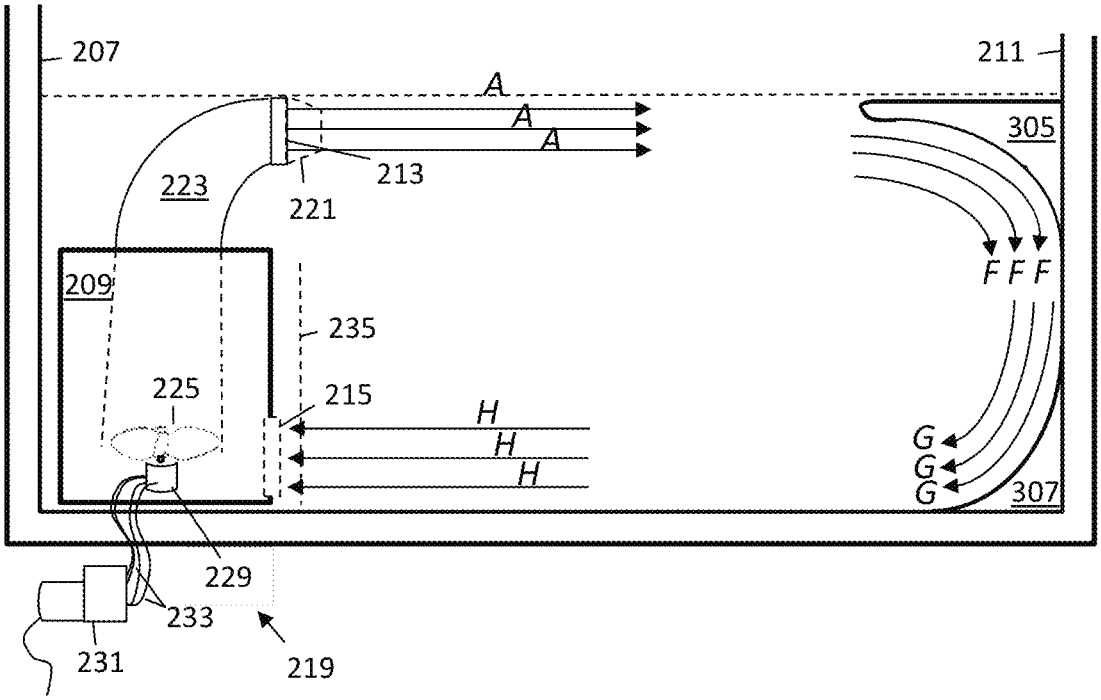
FIG. 5 is a side elevational view of the swim spa of FIG. 3 illustrating water flow.

As shown in FIG. 5, pumping equipment 219 forces a forward current of water through curved ducts 223 to the output window 213. The output window 223 is significantly wider than high. It is also placed at or above the top surface of the water. This allows the forward current, arrows "H", to remain as close to the surface as possible. There is little or no friction with the air above the water surface. Also, by keeping the window with little depth, as the water progresses toward the swimmer, it expands in depth which may approximate the depth of the swimmer swimming on the top surface of the water.

In an alternative embodiment, an optional nozzle 221 is used which can adjust the width and depth of the forward current (arrows "A"). Also, in another alternative embodiment, the nozzle 221 may slightly adjust the direction of the forward current (arrows "A") to compensate for offsets due to changes in velocity, structure or obstructions to direct the forward current (arrows "A") in the desired direction.

In another alternative embodiment, some or all of the functions of a nozzle described above may be performed by adjustable louvers within the path of the forward current (arrows "A").

Referring to FIG. 3 now, in order to minimize the back-pressure, turbulence and collisions with the rebounding streams, the present invention employs several features to direct the flow. In order to reduce the impact with the foot wall 211, a center diverter 301 is employed. Optionally, two side diverters 303 are also employed. As the forward current (arrow "A") meets the central diverter 301, it is split into two separate streams to the left and right each indicated by arrows "F". The current flow is now outward toward the sidewalls 201. When the current flow meets the side diverters 303, the current is gradually turned from sideways to a direction generally toward the head wall 207 as shown by arrows "G". The water stream "G" runs along the side wall 201 and into an intake window 215 as shown by arrows "H" as intake current.

In an optional embodiment, the side diverters 303 stop just short of a complete 90 degree turn and retain a component of its centrifugal force. This centrifugal force causes the water stream "G" to be forced against, and run along the side wall 201 and into an intake window 215 as shown by arrows "H" as a more distinct intake current providing less turbulence and interference with the forward current (arrows "A").

FIG. 5 is a side elevational view of the swim spa of FIG. 3 illustrating water flow. As the forward current (arrow "A") is expelled from the curved duct 223, it meets the upper diverter 305, and is diverted downward as indicated by arrows "F".

A lower diverter 307 then continuously redirects the downward current (arrows "G") to a current toward the head wall 207, shown by arrows marked "G". The water stream "G" runs along the bottom and into an intake window 215 as shown by arrows "H" as an intake current.

In an optional embodiment, the lower diverter 307 stops just short of a complete 90-degree turn allowing the current (arrows "G") to retain a component of its centrifugal force. This centrifugal force causes the water current "G" to be forced against, and run along the floor and into an intake window 215 as shown by arrows "H" as a more distinct intake current providing less turbulence and interference with the forward current (arrows "H").

The diverters described above, may be employed in the plane shown in FIG. 3 or in the plane shown in FIG. 5. Any or all parts of this may be embodied in both dimensions to three-dimensional curved return paths.

In order to make the diverters more efficient, the radius of curvature of the curved portion decreases over its length, approximating one half of a parabola. This may be referred to as a parabolic shape. The water encounters the diverter with a given speed. Therefore, the energy required to redirect the water is at its highest. Therefore, it is redirected a minimal amount. This equate to a large radius of curvature. As the water passes along the curved surface, it slows. The radius of curvature is gradually decreased along the length of the curved surface to minimize turbulence created, the wasted energy and increase the efficiency of the diverter.

Even though the novel features of this invention have been described in connection with a swim spa without dedicated return ducts, all will also be applicable to increase the efficiency of those having dedicated return ducts such as swim spas similar to those described in the Murdock and the Hatanaka patents described above. The design shown in FIG. 3 where the diverter splits the forward current and sends each sideways would work well with a swim spa similar to that disclosed in the Murdock patent.

The design shown in FIG. 5 where the diverter diverts the forward current "A" downward, would work well with a swim spa similar to that disclosed in the Hatanaka patent.

FIG. 6 is a partial side elevational view of another embodiment of the pumping equipment 219 of the swim spa according to the invention, illustrating water flow. In this embodiment, hydraulic motors 229 and propellers are positioned to have an axis which is horizontal. The hydraulic pump 231 provides high pressure hydraulic fluid to hydraulic motors 223 causing them to spin the propellers 225. The spinning propellers 225 then force water through chamber 224 and out output window 213.

In still another alternative of the embodiment of FIG. 5, the inlet tank 209 and the intake windows 215 may be removed. A partial barrier, netting, or a mesh 235 may be used to prevent the swimmer from coming close to propellers 225, but still allowing water to pass through. This actually increases water return and prevents water cavitation when the propeller is operating at high speeds.

In still another alternative embodiment, FIG. 6 can be modified to remove the inlet tank 209 and the intake windows 215. A partial barrier, netting, or a mesh 235 may be used to prevent the swimmer from coming close to propellers 225, but still allowing water to pass through. This would increase water return and prevents water cavitation when the propeller is operating at high speeds. The partial barrier may be partial walls, shields, protrusions, bars, poles, fences or other conventional means that can function to keep the swimmer or the swimmer's appendages from coming near any moving parts associated with the pumping equipment, that also does not prevent the movement of water toward the propeller.

3. SWIM SPA WALL INSERT

In order to address the shortcomings of the prior, known swim spas, as discussed earlier, reference is made now to FIGS. 7-12, where there is illustrated a swim spa wall insert 400 for use with a swim spa 200. As will be explained hereinafter in greater detail, the swim spa wall insert 400 can be used to raise up the pumping equipment 219 (FIGS. 10-12) of the swim spa 200 so that the pumping equipment 219 can be maintained, repaired or replaced without having to remove any water from the swim spa 200.

Figure 7:
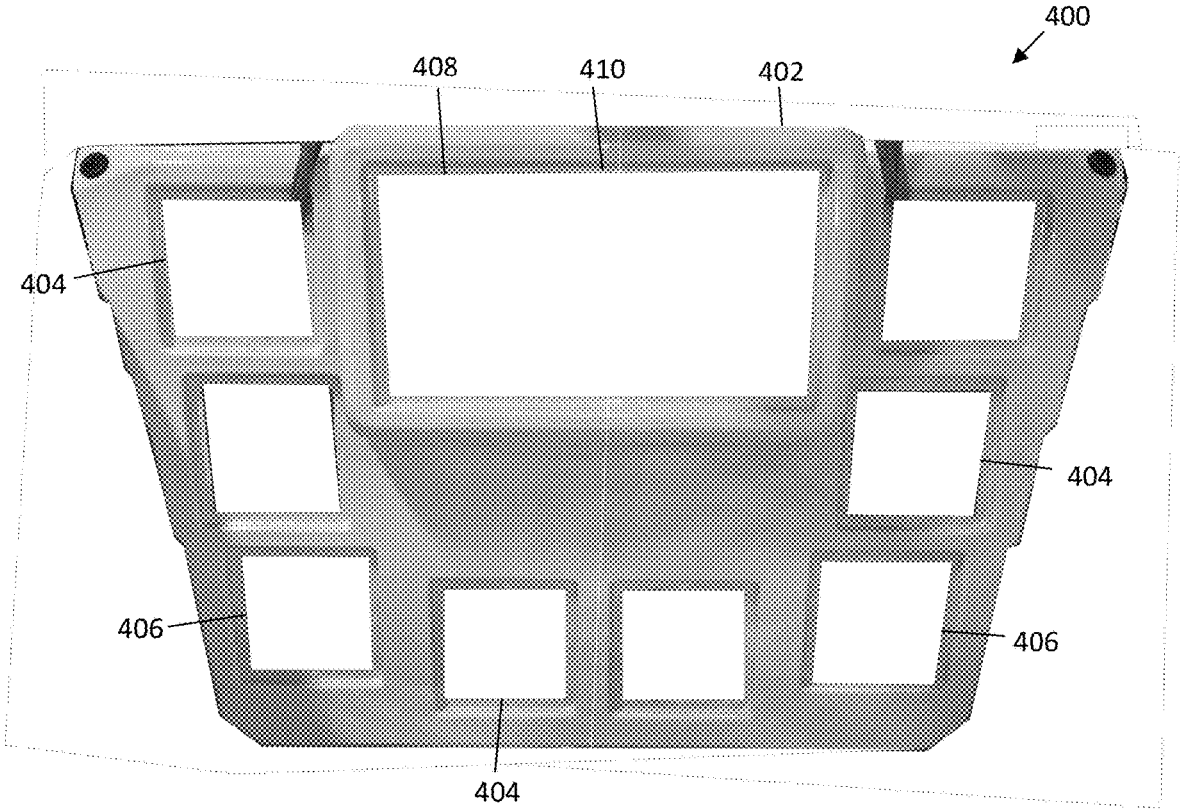
FIG. 7 is a front view of a swim spa wall insert, according to the invention.
Figure 8:
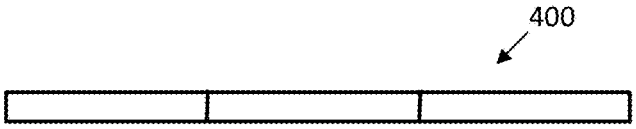
FIG. 8 is a side view of the swim spa wall insert of FIG. 7, taken along lines 8-8, according to the invention.

As shown in FIGS. 7 and 8, swim spa wall insert 400 includes, in part, insert frame 402, water flow openings 404, water flow openings recesses 406, pumping equipment opening 408, and pumping equipment opening recess 410. Preferably, swim spa wall insert 400 is constructed of any suitable, durable, lightweight, high-strength material such as, but not limited to, acrylic and fiberglass. It is to be understood that swim spa wall insert 400 should be constructed so that it can be safely and securely retained between the side walls 201 of the swim spa 200 (FIGS. 9-12), as will be discussed in greater detail later.

Figure 9:
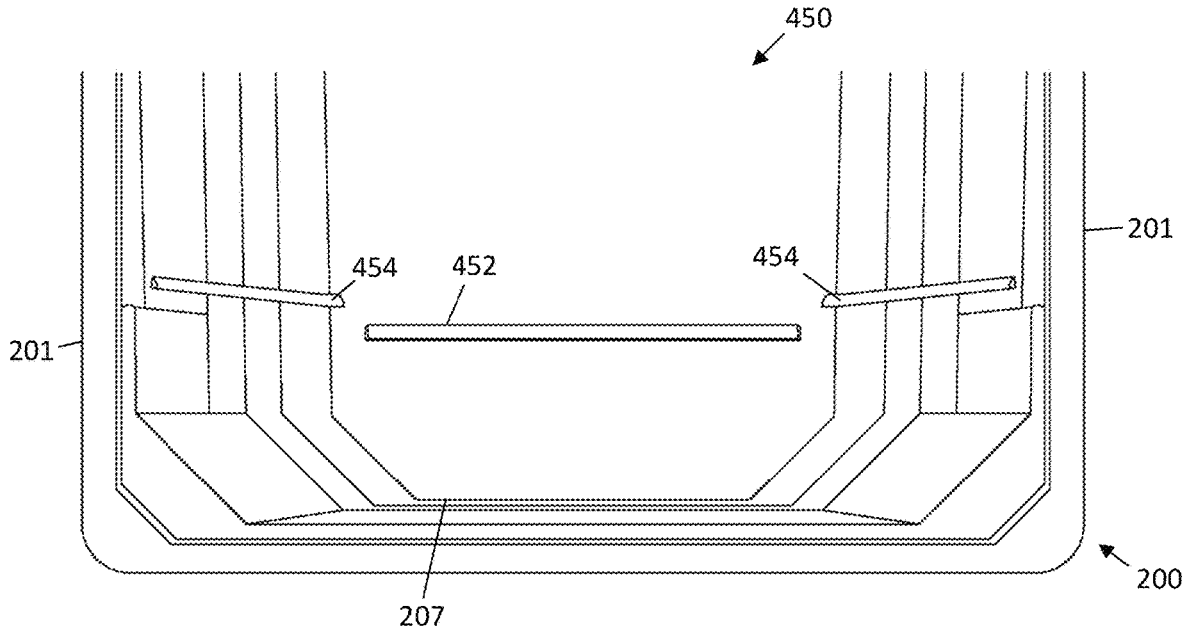
FIG. 9 is a top view of the swim spa wall insert retainers in the swim spa, according to the invention.
Figure 10:
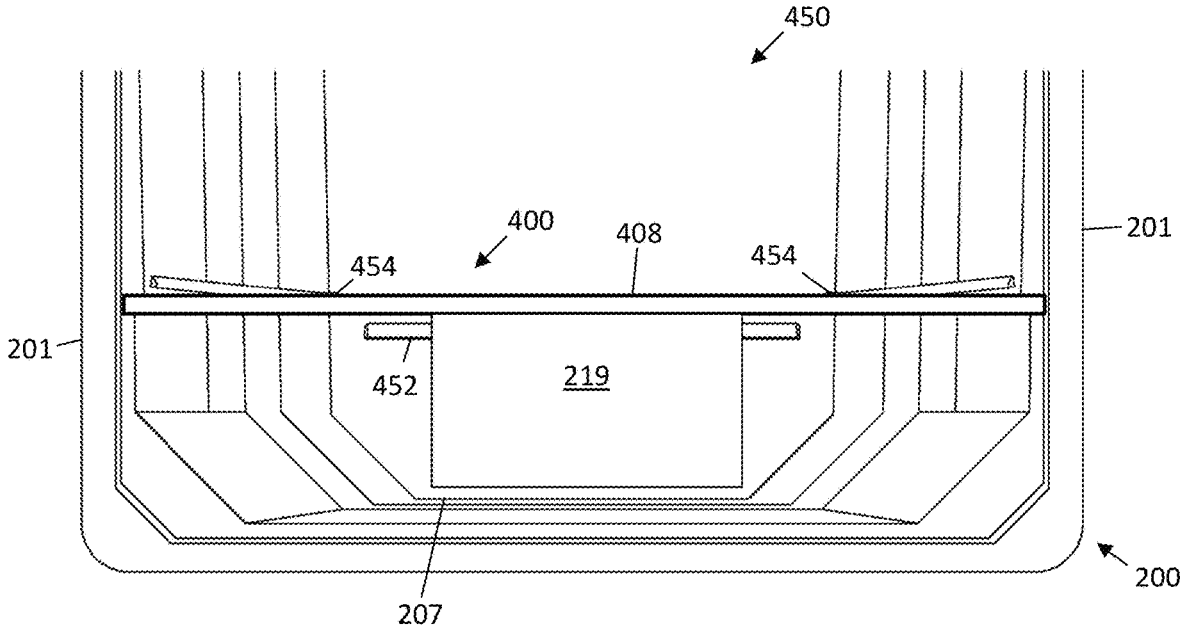
FIG. 10 is a top view of the swim spa wall insert being retained by the swim spa insert retainers, according to the invention.
Figure 11:
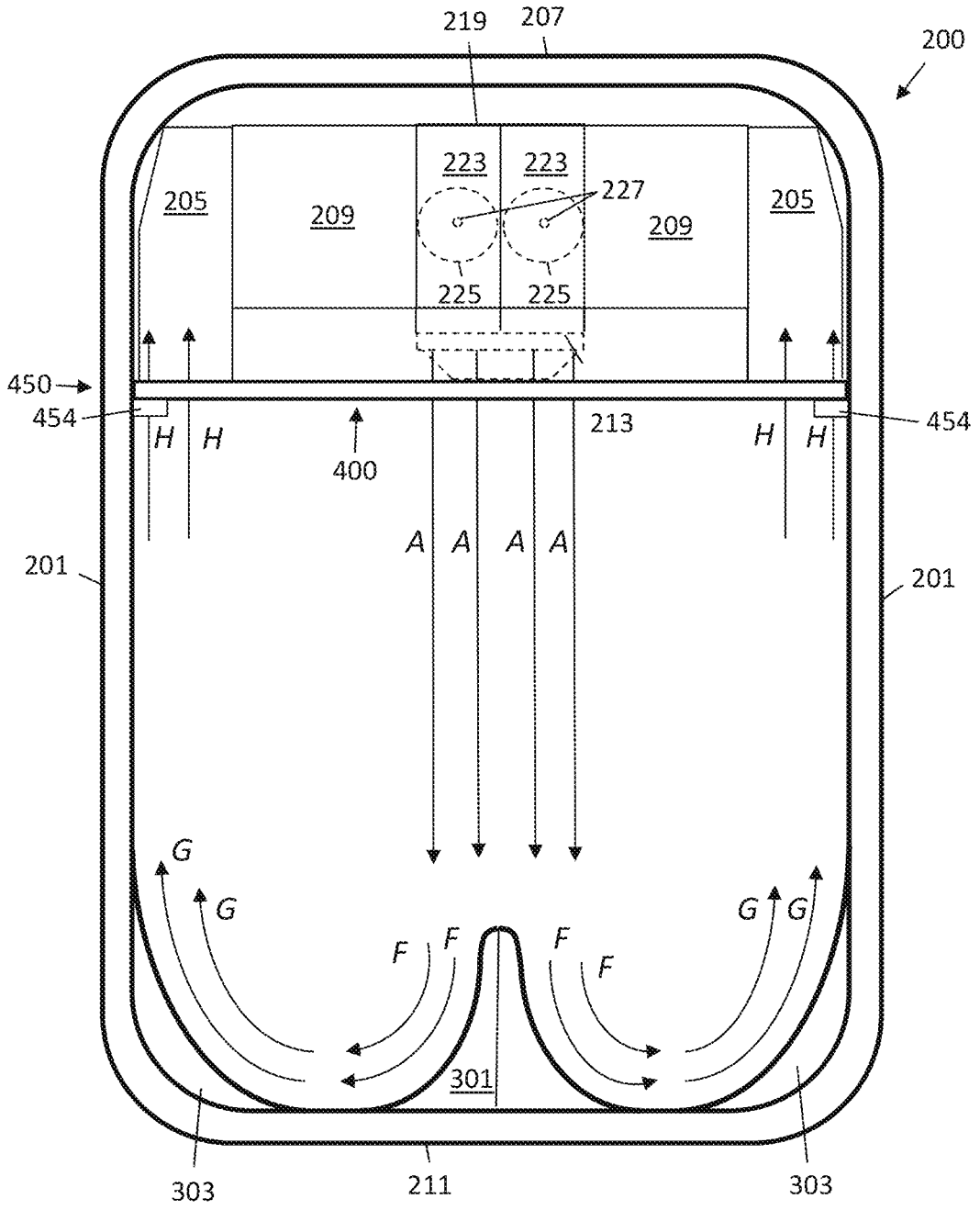
FIG. 11 is a top view of the swim spa wall insert being retained by the swim spa insert retainers with the pumping equipment being attached to the swim spa wall insert, according to the invention.

Regarding swim spa 200, as shown in FIGS. 9-11, swim spa 200 has been equipped with swim spa wall insert retainer assembly 450. Swim spa wall insert retainer assembly 450 is used to securely retain swim spa wall insert 400 within swim spa 200, as will be described in greater detail later. Swim spa wall insert retainer assembly 450 includes, in part, swim spa bottom retainer 452 and swim spa side wall retainers 454. Preferably, swim spa bottom retainer 452 and swim spa side wall retainers 454 are conventionally formed into the structure of the swim spa bottom and the swim spa side walls 210, respectively, by molding or the like. However, it is to be understood that swim spa bottom retainer 452 and swim spa side wall retainers 454 could be constructed of conventional, individual parts and conventionally secured to the bottom and sides of the swim spa 200, respectively. Furthermore, it is to be understood that swim spa bottom retainer 452 and swim spa side wall retainers 454 should be constructed so that they will securely retain swim spa wall insert 400 within swim spa 200.

During the operation of swim spa wall insert 400, as shown in FIGS. 9-12, swim spa wall insert 400 is located within swim spa wall insert retainer assembly 450. At this point, pumping equipment 219 is conventionally attached to pumping equipment opening recess 410 such that pumping equipment 219 will cause the water in the swim spa 200 to be pumped away from head wall 207 and through pumping equipment opening 408 (FIG. 10), as discussed earlier. It is to be understood that conventional safety barriers (not shown) such as screens or the like can be retained in front of the pumping equipment 219 in pumping equipment opening recess 410 and water flow openings recess 406 in order to prevent the end user from inadvertently contacting the pumping equipment 219 and/or interfering with the water flow through water flow openings 404.

Figure 12:
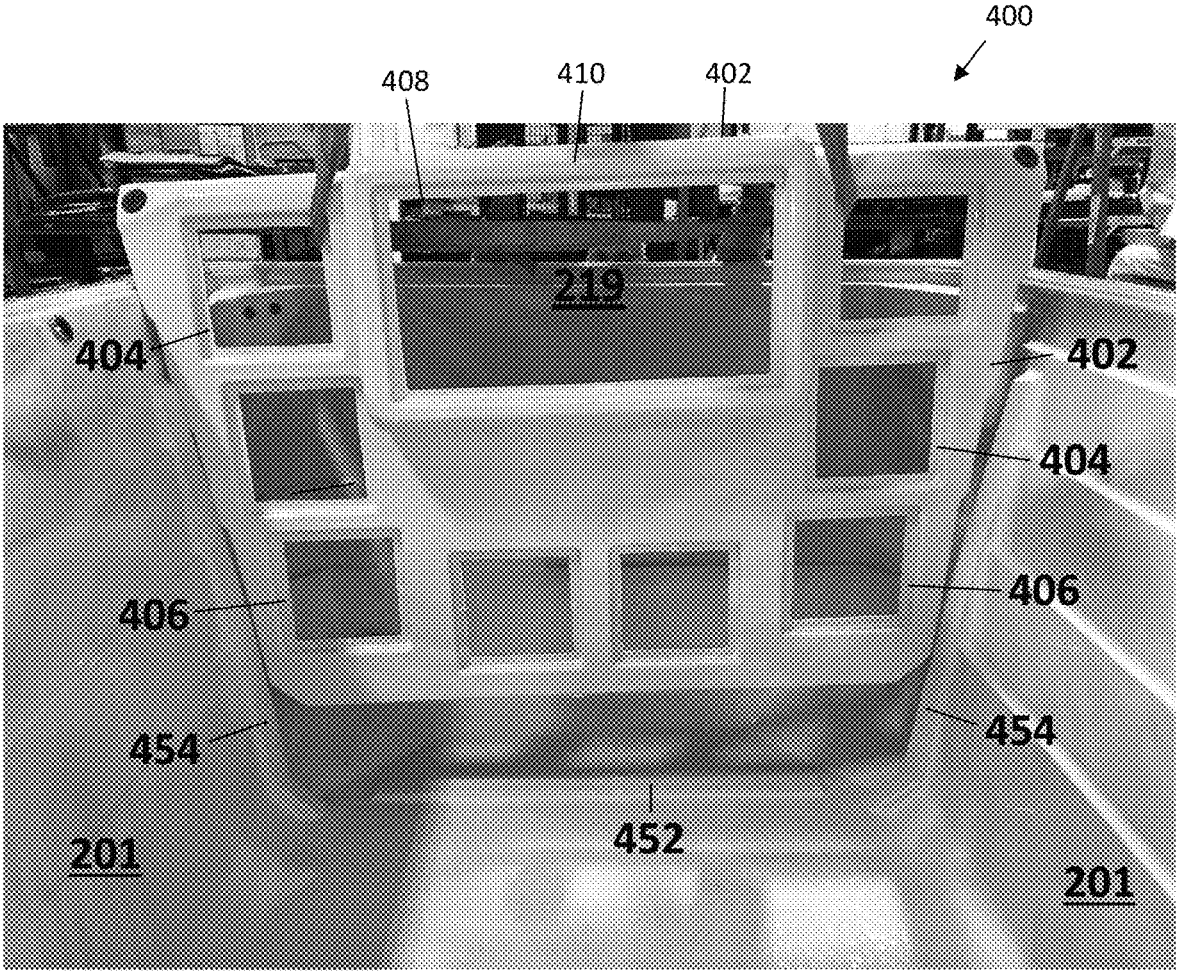
FIG. 12 is a front view of the swim spa wall insert being lifted away from the swim spa insert retainers for maintenance, repair or replacement of the pumping equipment, according to the invention.

A unique aspect of the present invention is that the swim spa wall insert 400 can be used to lift the pumping equipment 219 out of the swim spa 200 if the pumping equipment 219 needs to be maintained, repaired or replaced. In particular, if the pumping equipment 219 needs to be maintained, repaired or replaced, the swim spa wall insert 400 is conventionally lifted up from the bottom of the swim spa 200 and away from swim spa bottom retainer 452 and swim spa side wall retainers 454, as shown in FIG. 12. In this manner, the pumping equipment 219 can be maintained, repaired or replaced without having to remove any water from the swim spa. It is to be further understood that swim spa wall insert can be completely removed from swim spa 200 so that the pumping equipment 219 can be maintained, repaired or replaced at a location away from the swim spa 200. Also, the use of the swim spa wall insert 400 should reduce the likelihood that the person performing the maintenance, repair or replacement of the pumping equipment 219 will experience an electrical shock due to being exposed to water during the maintenance, repair or replacement of the pumping equipment 219.

Another unique aspect of the invention is that connecting lines (typically hydraulic lines) between the hydraulic pump and the hydraulic motors are installed above the water line and run under the swim spa wall insert 400. In this manner, the connecting lines are not run through the swim spa walls and thus do not require any type of seal. Furthermore, when the swim spa wall insert 400 is raised or lifted, the connecting lines will not have to be pulled through any openings in the swim spa walls.

While the present disclosure illustrates various aspects of the present teachings, and while these aspects have been described in some detail, it is not the intention of the applicant to restrict or in any way limit the scope of the claimed systems and methods to such detail. Additional advantages and modifications will readily appear to those skilled in the art. Therefore, the teachings of the present application, in its broader aspects, are not limited to the specific details and illustrative examples shown and described. Accordingly, departures may be made from such details without departing from the spirit or scope of the teachings of the present application. Moreover, the foregoing aspects are illustrative, and no single feature or element essential to all possible combinations may be claimed in this or a later application.

What is claimed is:

1. A more efficient swim spa requiring less energy to operate, comprising:

a. a tank having a head end and a foot end, the tank being filled with a volume of water, the tank comprising:
   i. a first side wall and a second side wall each having a head end and a foot end;
   ii. a foot wall positioned substantially perpendicular to the side walls, thereby connecting the foot ends of the side walls;
   iii. a head wall positioned substantially perpendicular to the side walls, thereby connecting the head ends of the side walls in order to create the tank;

b. pumping equipment that includes at least two side-by-side propellers that are driven by a single drive and at approximately equal speed that create a single forward current of water limited to one or more output windows at a surface of the water, wherein the single forward current of water has a width at least twice a height of the forward current of water;

c. a nozzle attached to the one or more output windows, wherein the nozzle is adapted to be continuously adjustable to adjust a width and height or angle of the forward current of water received from the output window such that the nozzle is capable of directing the single forward current of water slightly below a surface of the water approximately down a center line of the tank;

d. a diverter located in the tank and attached to the foot wall, wherein the diverter includes at least one curved surface for smoothly diverting the forward current toward an inside surface of a side wall inside the tank, thereby reducing turbulence and energy required to operate the swim spa, wherein the diverter includes an upper diverter in the tank connected to the foot wall having at least one curved surface for smoothly diverting the forward current downward towards a floor inside the tank and at least one lower diverter in the tank connected to the floor, having a curved surface that receives the forward current of water flowing downward towards the floor in the tank and redirects the current of water toward the head wall inside the tank;

e. a removable wall insert having a plurality of openings, wherein the pumping equipment is operatively connected to the wall insert at one of the plurality of openings, wherein the forward current of water exits the one of the plurality of openings and wherein the removable wall insert is capable of being lifted in order to maintain, repair or replace the pumping equipment.

2. The more efficient swim spa of claim 1, wherein the pumping equipment comprises: a single drive mechanism driving the at least two side-by-side propellers in parallel.

3. The more efficient swim spa of claim 2, wherein the drive mechanism comprises:

a. a hydraulic motor coupled in parallel to the at least two side by side propellers, thereby causing the hydraulic motor to rotate the propellers at approximately the same rate when the hydraulic motor receives pressurized hydraulic fluid;

b. a hydraulic pump for providing high pressure hydraulic fluid to the hydraulic motor;

c. a hydraulic supply line coupled to the hydraulic motor for providing the high pressure hydraulic fluid to the hydraulic motor;

d. a return hydraulic line coupled to the hydraulic motor, for returning the hydraulic fluid after the hydraulic fluid passes through the hydraulic motor.

4. The more efficient swim spa of claim 1, wherein the removable wall insert is further comprised of:

another of the plurality of openings in the wall insert, wherein the another of the plurality of openings in the wall insert allows the redirected current of water toward the head wall inside the tank to be directed towards an intake of the pumping equipment.

5. The more efficient swim spa of claim 1, wherein the swim spa is further comprised of:

a swim spa wall insert retainer assembly located adjacent to the head wall for removably retaining the removable wall insert.

6. The more efficient swim spa of claim 5, wherein the swim spa wall insert retainer assembly is further comprised of;

a swim spa bottom retainer operatively connected to a bottom of the tank; and a first and second swim spa side wall retainers, wherein the first swim spa side wall retainer is operatively connected to the first side wall and the second swim spa side wall retainer is operatively connected to the second side wall, wherein the removable wall insert is capable of being removably retained within the swim spa bottom retainer and the first and second swim spa side wall retainers.

7. A method of allowing a swimmer to swim in place comprising the steps of:

a. providing a tank filled with water having a head wall and a foot wall, a first side wall, a second side wall and a floor; wherein at least the side walls are substantially flat to reduce turbulence;

b. using a pumping equipment having side-by-side propellers and a nozzle to provide a single forward current of water having a width at least twice a forward current's depth passing from the head wall of the tank toward the foot wall past a swimmer, wherein the forward current of water has a height and width at the swimmer's location which approximates a height and width of the swimmer as the swimmer is actively swimming and, wherein the nozzle has a variable adjustment to adjust a width and height or angle of the forward current and the nozzle directs the forward current of water to be slightly below a surface of the water approximately down a center line of the tank;

c. providing a removable wall insert having a plurality of openings, wherein the pumping equipment is operatively connected to the wall insert at one of the plurality of openings and wherein the forward current of water exits the one of the plurality of openings; and d. smoothly redirecting the forward current of the water toward one of the first side wall, the second side wall, and the floor using a diverter located inside the tank attached to the foot wall, wherein the diverter includes a smooth curved surface to result in a more efficient swim spa, wherein the diverter includes an upper diverter inside the tank attached to the foot wall having at least one curved surface for smoothly diverting the forward current downward towards a floor inside the tank and at least one lower diverter inside the tank, attached to the floor having a curved surface that receives the current of water flowing downward towards the floor and redirects the current of water towards the head wall.

8. The method of claim 7 wherein the step of smoothly redirecting the forward current of the water comprises the step of: smoothly redirecting the forward current of the water by using a parabolic shaped diverter.

9. The more efficient swim spa of claim 1, wherein the curved surface of the diverter has a parabolic shape.

10. The more efficient swim spa of claim 1, wherein the curved surface of the upper diverter and the lower diverter has a parabolic shape.

11. The method of claim 7, wherein the step of providing a removable wall insert is further comprised of the step of:

providing another of the plurality of openings in the wall insert, wherein the another of the plurality of openings in the wall insert allows the redirected current of water toward the head wall inside the tank to be directed towards an intake of the pumping equipment.

12. The method of claim 7, wherein the method is further comprised of the step of:

providing a swim spa wall insert retainer assembly located adjacent to the head wall for removably retaining the removable wall insert.

13. The method of claim 7, wherein the method is further comprised of the step of:

lifting the removable wall insert in order to maintain, repair or replace the pumping equipment.

* * * * *